US009448043B2

(12) United States Patent
Roberts

(10) Patent No.: US 9,448,043 B2
(45) Date of Patent: Sep. 20, 2016

(54) INTERACTIVE TARGET AND SYSTEM FOR LONG RANGE SHOOTING

(71) Applicant: Roberts Tactical Precision, Inc., Arlington, WA (US)

(72) Inventor: Kirk J. Roberts, Arlington, WA (US)

(73) Assignee: Roberts Tactical Precision, Inc., Alrington, WA (US)

( * ) Notice: Subject to any disclaimer, the term of this patent is extended or adjusted under 35 U.S.C. 154(b) by 0 days.

(21) Appl. No.: 14/193,846

(22) Filed: Feb. 28, 2014

(65) Prior Publication Data

US 2015/0247709 A1 Sep. 3, 2015

(51) Int. Cl.

| | |
|---|---|
| ***G08B 1/08*** | (2006.01) |
| ***F41J 5/14*** | (2006.01) |
| ***F41J 5/04*** | (2006.01) |
| ***F41J 5/056*** | (2006.01) |

(52) U.S. Cl.

CPC .. *F41J 5/14* (2013.01); *F41J 5/04* (2013.01); *F41J 5/056* (2013.01)

(58) Field of Classification Search

None

See application file for complete search history.

(56) References Cited

U.S. PATENT DOCUMENTS

| | | | | |
|---|---|---|---|---|
| 3,434,226 | A * | 3/1969 | Schaller | 434/22 |
| 5,375,847 | A * | 12/1994 | Fromm et al. | 463/5 |
| 5,437,463 | A * | 8/1995 | Fromm | 463/5 |
| 2003/0134700 | A1* | 7/2003 | Salva | 473/476 |
| 2003/0171150 | A1* | 9/2003 | Oki | F41J 5/14 463/51 |
| 2003/0195046 | A1* | 10/2003 | Bartsch | 463/49 |
| 2005/0153262 | A1* | 7/2005 | Kendir | 434/21 |
| 2013/0065713 | A1* | 3/2013 | Faecher | G06F 1/1626 473/480 |
| 2013/0193645 | A1* | 8/2013 | Kazakov et al. | 273/372 |
| 2014/0027982 | A1* | 1/2014 | Chiu | F41J 9/00 273/359 |
| 2014/0151965 | A1* | 6/2014 | Garas | 273/371 |
| 2014/0367918 | A1* | 12/2014 | Mason | 273/371 |
| 2015/0025842 | A1* | 1/2015 | Hodge | 702/150 |
| 2015/0123346 | A1* | 5/2015 | Mason | 273/371 |
| 2015/0354922 | A1* | 12/2015 | Carriere | F41G 3/2616 434/21 |
| 2016/0084618 | A1* | 3/2016 | Hong | F41J 5/14 273/371 |

* cited by examiner

*Primary Examiner* — Julie Lieu

(74) *Attorney, Agent, or Firm* — Mark P. Waters; Lowe Graham Jones PLLC

(57) ABSTRACT

An interactive target assembly is disclosed and claimed herein wherein the target assembly is meant to provide real-time feedback to a shooter or other remote onlooker. The shooter or other party can visually detect a strike to the target by way of a high powered LED light that is in wired communication with a target control module. The target control module is thereby in wireless communication via a multi-channel receiver with a remote control and an impact detection module. The impact detection module detects an impact to the target, sending a signal to the target control module, which illuminates a light to indicate a strike.

14 Claims, 6 Drawing Sheets

INTERACTIVE TARGET AND SYSTEM FOR LONG RANGE SHOOTING

FIELD OF THE INVENTION

The invention relates to long range shooting, particularly to targets for long range shooting that provide feedback to the shooter.

BACKGROUND OF THE INVENTION

Long range, precision shooting is a skill that requires extensive training and the use of repeated shots at a target or a plurality of targets. Ideally, targets used for such training are reusable and due to the high velocity of long range firearm ammunition, long range targets must be constructed of highly durable materials. Due to the relatively long distances involved in target training, often in excess of 500 yards, recovery of the target to inspect for hits after a selected number of shots to judge the shooter's accuracy is impractical unless the shooter is willing to wait the time necessary for the target area to be cleared of shooters and for travel to be made to the location of the target so that the target may be inspected. Time necessary for such an inspection does not permit the shooter to make real-time adjustments or to examine his or her position or settings in real-time in order to make necessary adjustments.

Military groups may employ long range metal targets made from sheets of R5400 steel or Hardox, generally approximately 1 cm thick. The targets can be suspended from A-frames or other similar suspension devices and placed at certain known distances from the shooting position. Such targets are often too far away for the shooter or others to visually ascertain the quality or quantity of a hit from the shooter's position without the use of a spotting scope or some other enhanced optical device. The use of a spotting scope or other enhanced optical device is cumbersome and time consuming for the shooter and does not provide the opportunity for the shooter to make adjustments based on feedback from the target being provided in real-time.

At very long ranges, in excess of 500 yards, however, the skill of the shooter and the consistency of the ammunition is often not enough to insure that the shooter will hit the target. In such situations, real-time feedback from the target can be helpful to determine what adjustments may be necessary under certain shooting conditions.

Some of the factors impacting accuracy, where real-time feedback is particularly helpful include "bullet drop." "Bullet drop" is caused by the influence of gravity on the moving bullet and is characterized by a bullet path which curves toward earth over long ranges. Therefore, to hit a target at long range, it may be necessary to elevate the barrel of the weapon, and the aiming point, to adjust for bullet drop.

Other factors, such as wind, Magnus effect (i.e., a lateral thrust exerted by wind on a rotating bullet whose axis is perpendicular to the wind direction), projectile design, projectile spin, Coriolis effect, and the idiosyncrasies of the weapon or projectile can change the projectile's path over long range. Such effects are generally referred to as "windage" effects. Therefore, for example, to hit a target at long range, it may be necessary to correct for windage by moving the barrel of the weapon slightly to the left or the right to compensate for windage effects. When shooting East and West the elevation will be effected. Shooting due East, the bullet impact will be high. Shooting due West, the bullet impact will be low. The elevation at extended range might change slightly up or down depending on the spin of the projectile in a right hand or left hand twist barrel. Thus, for example, in order to hit a target at long range, the shooter must see the target, accurately estimate the range to the target, estimate the effect of bullet drop and windage effects on the projectile, and use this information to properly position the barrel of the firearm prior to squeezing the trigger. In all these situations, obtaining real-time feedback from the target can be helpful in making necessary adjustments.

Sometimes long range targets may be configured to provide audio feedback, but audio feedback can be misinterpreted and mishits may be recorded as hits using audio feedback. For example, sometimes rocks or other debris may come into contact with the target, making a sound when it hits the target. In such cases, the round may not have hit the target, but the debris may nevertheless be recorded as a hit.

There are other problems with targets configured to provide audio feedback. Principally, these targets generally have no capacity to provide precision location information for hits. Meaning, they do not provide accurate information regarding what part of the target was hit. Additionally, these targets are hard to use in relatively noisy locations such as in busy shooting ranges or in heavy training drills where multiple shooters are training to engage the closely positioned targets.

The percussive force of a long range firearm round is jarring and can dislodge or damage the target. Due to the high velocity of long range rounds, the metal targets used are subjected to significant momentary deformation upon impact which generates severe vibrations in the target. These vibrations are so severe that they often lead to damage of bolted or welded connections on the target, for example for the connection to the target suspension structure. In long range targets, cracking and failure of bolts and welds are commonly observed after even a short period of use, due to this severe vibration or stress Long range targets, although constructed to withstand impact without penetration are often also permanently deformed, especially when used at the close end of the target range. Such permanent deformations place additional strain on the target already stressed by the repeated vibration load and accelerate target disintegration. Thus, using laminated structures and/or specialized pockets directly attached to the target for mounting devices to a long range target are undesirable, since they may not be able to reliably withstand repeated use of the target.

Additionally, for shooting competitions, the range operator or scorekeeper cannot always tell whether the target has been hit. This is especially true during competitions held in bad visibility conditions or over long ranges in excess of 1000 or 1500 yards. In such a case, the scorekeeper or range operator must use a spotting scope and scoring takes time away from other activities. Furthermore, spectators are largely unable to see hits in real-time during competition.

There is a need, therefore, for durable, reusable targets for use in long range shooting that can withstand multiple hits and can provide feedback to the shooter on a real-time basis regarding the hit, and in particular the quality or location of the hit. There is also a need to provide information from the target to the shooter in real-time that may be used to adjust for the effects of windage, bullet drop, Magnus effect, and other anomalies impacting the accuracy of shooting at long range. Finally, there exists a need for an interactive target that can display and confirm hits via a color coordinated lighting system which is not only viewable from the shooting position, but visible to spectators and shooting range operators or score keepers without the use of a spotting scope or other optical devices.

SUMMARY OF THE INVENTION

An interactive target for long range shooting comprising a target assembly is disclosed and claimed. The target assembly includes an impact surface and an impact detection module, wherein the impact detection module includes an impact sensor, a remote transmitter, and a battery. The interactive target also includes a light and a target control module, wherein the target control module includes a multi-channel receiver, a battery, a capacitor, and a potentiometer.

The invention also includes an interactive target for long range shooting where the interactive target comprises a target assembly with an impact surface, the target assembly further including a target control module and a light; wherein the target control module is wired to the light and wherein the target control module has a multi-channel receiver configured to receive signals from a plurality of remote devices.

Finally, the invention includes a system for long range shooting comprising the following a plurality of targets, a plurality of impact detection modules, a plurality of target control modules, a plurality of lights, and a computer.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
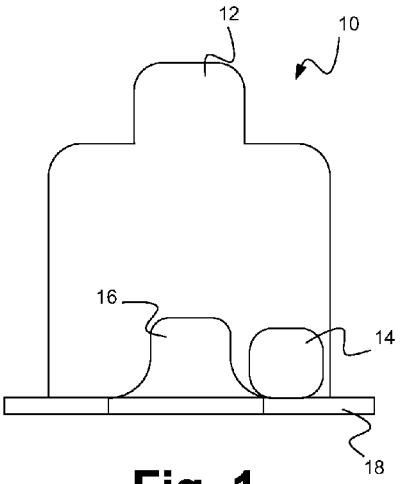
FIG. 1 is a rear view, representative of the backside of a long range target constructed in accordance with principles of the present invention.
Figure 1A:
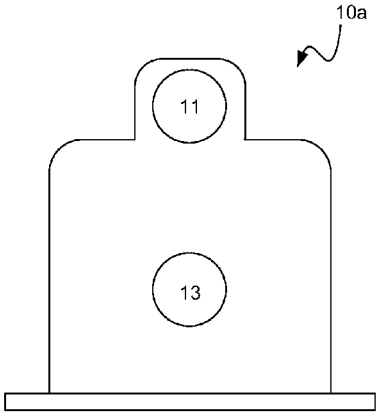
FIG. 1A is a front view, representative of the front side of a long range target constructed in accordance with principles of the present invention.

FIGS. 1 and 1A show a target constructed in accordance with principals of the present invention. In FIG. 1, the target assembly 10 shows the rear surface 12 of target assembly 10. FIG. 1A shows the impact surface of target assembly 10, as well as a first target indicator 11 and second target indicator 13. First target indicator 11 and second target indicator 13 may be of a variety of contrasting colors when compared to the tone or background color of the impact surface; this is in order to assist the shooter in spotting the target through a scope or other spotting device. The target assembly 10 sits atop a base 18 that provides substantial support in order maintain the target assembly 10 in a substantially upright position. Base 18 may take on any number of configurations, including a generally rectangular configuration, a circular configuration, a hexagonal configuration or be constructed out of several strips of longitudinally extending steel. Base 18, regardless of the shape, may include a variety of fastening holes through which bolts and nuts may be used to securely affix target assembly 10 atop another structure, such as a moveable target track, a vehicle, or other device or arrangement.

The shape of the impact surface for target assembly 10 as shown in FIGS. 1 and 1A is generally a "head" and "body" configuration constructed from one sheet of material cut generally into an eight-sided shape, with the head portion at one end of the shape, demarked by three sides, where two opposing sides are connected by a third side at generally right angles. The corners of the sheet are rounded, but need not be. In general, the shape of the impact surface for assembly 10 is not intended to be a limiting feature of the invention; it is being described here for illustrative rather than limiting purposes.

In general, target assembly 10 has a front, impact surface and a rear surface and is constructed of hardened steel for withstanding repeated impact by high velocity rounds on the impact surface without penetration. Target assembly 10 may include a heating element that heats a target region of the target so that the target may be better seen through night-vision optical devices designed for training in the dark and for picking up on contrasting heat signatures.

As shown in FIG. 1, target assembly 10 includes an impact detection module 14 and a hinge assembly 16. Hinge assembly 16 utilizes hinges integrally formed from the same material as the target assembly, a rotational pin, and a heavy-duty spring. The heavy-duty spring is biased to return the impact surface of target assembly 10 into a substantially upright position after the impact surface is struck by a round. In operation, the impact surface will tip in the direction of impact in response to a hit, and the target will thereafter return to a substantially upright position following a hit due to the tension in the spring.

Impact detection module 14 may be fastened to the rear surface of target assembly 10 using fastening structures. The fastening structure includes a vibration dampening portion for at least partially insulating the impact detection module 14 and potentially a heating element from vibrations of the target body generated on impact by the firearm round. The target is preferably made of R5400 steel or HARDOX500 steel.

With further reference to FIGS. 1 and 1A, the target assembly 10 can be fabricated from armor plate steel (AR Hardox R600, R500, or similar) and has a front, impact surface and a rear surface 12. The target assembly 10 is generally about 24" high and has a thickness of about ⅜". Thicker plates can be employed for use in target practice with .50 caliber firearms.

Preferred fastening materials for use in connection with the attachment of impact detection module 14 to the rear surface 12 of target assembly 10 include liquids or gels which are settable and which retain a high degree of elasticity after full curing. Exemplary materials are commercially available silicone rubber or butyl rubber compounds. Preferred adhesive fastening materials are those which remain not only flexible, but elastic after curing, to maintain any vibrational, thermal, and mechanical connection to the target assembly 10 even if the latter is deformed, for example by projectile impact.

Although the targets of the invention have been described above for use as stationary targets for long range firearm training, they can also be adapted for various other firearm training scenarios. For example, the targets can be directly mounted on the ground or mounted in an A-frame or on moveable tracks or devices. For shorter range applications, the target body shape may be altered (i.e., an 8" by 8" square sheet of AR 500, AR 600 steel, or equivalent). In this embodiment, the target would be preferably mounted at an angle tilted away from the shooter, preferably at an angle of not less than 30 degrees.

In addition to the discussion above pertaining to target assembly 10 shown in FIGS. 1 and 1A, the invention can be further described by reference to FIG. 2 which shows a target indication assembly 20. Target indication assembly 20 includes an uppermost light 22 which is preferably encased in a weather proof encasement 24. Weather proof encasement 24 is sized and configured to house an antenna 24. Antenna 24 is in communication with devices located at long ranges from the target area, i.e., distances greater than 500 yards.

Figure 2:
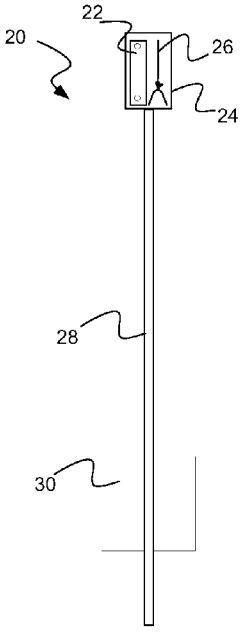
FIG. 2 is a target indication assembly, representative of the kind built in accordance with principles of the present invention.

With further reference to FIG. 2, target indication assembly 20 includes a pole 28 and a target control module 30. Pole 28 may be constructed from any lightweight and durable material. As constructed in this particular embodiment, target control module 30 is in wired communication with light 22, but the invention contemplates a completely wireless design and communication between target control module 30 and light 22.

As constructed in this particular embodiment, target control module 30 is in wireless communication with impact detection module 14 (depicted in FIG. 1), but the invention contemplates a wired design as well, whereby target control module 22 may be "hardwired" to impact detection module 14 (depicted in FIG. 1).

Impact detection module 14 is configured to include RF communication that will trigger a pre-determined communication signal upon impact of the target assembly 10. In general, impact detection module 14 will send an RF signal to an RF receiver located inside of target control module 30, whereupon target control module 30 will supply power to light 22 to signal a hit on the target. Target control module 30 may also be in wireless communication with other devices remotely located from the shooting position. For example, in one embodiment, a second channel of the same receiver located inside of target control module 30 is in wired communication with antenna 26, which, in turn, receives wireless RF signals from long range, i.e., from distances greater than 500 yards. These long range wireless signals may include a remote control indicator that is configured and programmed to power the target indication assembly 20 on and off. Moreover, this long range wireless signal may power on the light 22, so that the shooter or spotter may indicate that the target is ready to be engaged. Additionally, these long range wireless signals may trigger any number of switches intended to change shooting conditions, such as triggering a heat element for night training, or trigger movement for engagement of a moving target.

Preferably, target control module 30 is in wireless communication with impact detection module 14 and the target assembly 10 is not more than 150 feet away from target indication assembly 20 and thereby not more than 150 feet away from target control module 30. Most preferably, target assembly 10 is not more than 50 feet away from target indication assembly 20.

Light 22 is preferably an LED light that is of sufficient brightness to be seen from long ranges, i.e., from distances greater than 500 feet. Most preferably, light 22 will be visible from distances of approximately 2000 yards. In one embodiment, wires putting light 22 in communication with target control module 30 are run inside of the pole 28 to facilitate a design that minimizes catching or snagging. Light 22 is configured to operate in any number of ways including via a pulse of variable length and frequency. Light 22 may pulse at a particular rate, including a particular length and frequency to indicate a shot and to distinguish the shot from another mode where the light is powered, such as via the remote control to power the target indication assembly 20 on, or to otherwise test the target indication assembly 20 or to wake the assembly from a standby mode.

Light 22 is preferably one that is encased in polycarbonate plastic and includes multiple LED lights providing variable flash patterns. The light 22 preferably runs off of 12-24 Direct Current Volts, drawing no more than 0.4 Amps. Preferably, the light has an operational temperature range from −22 degrees F. to +122 degrees F.

Figure 3:
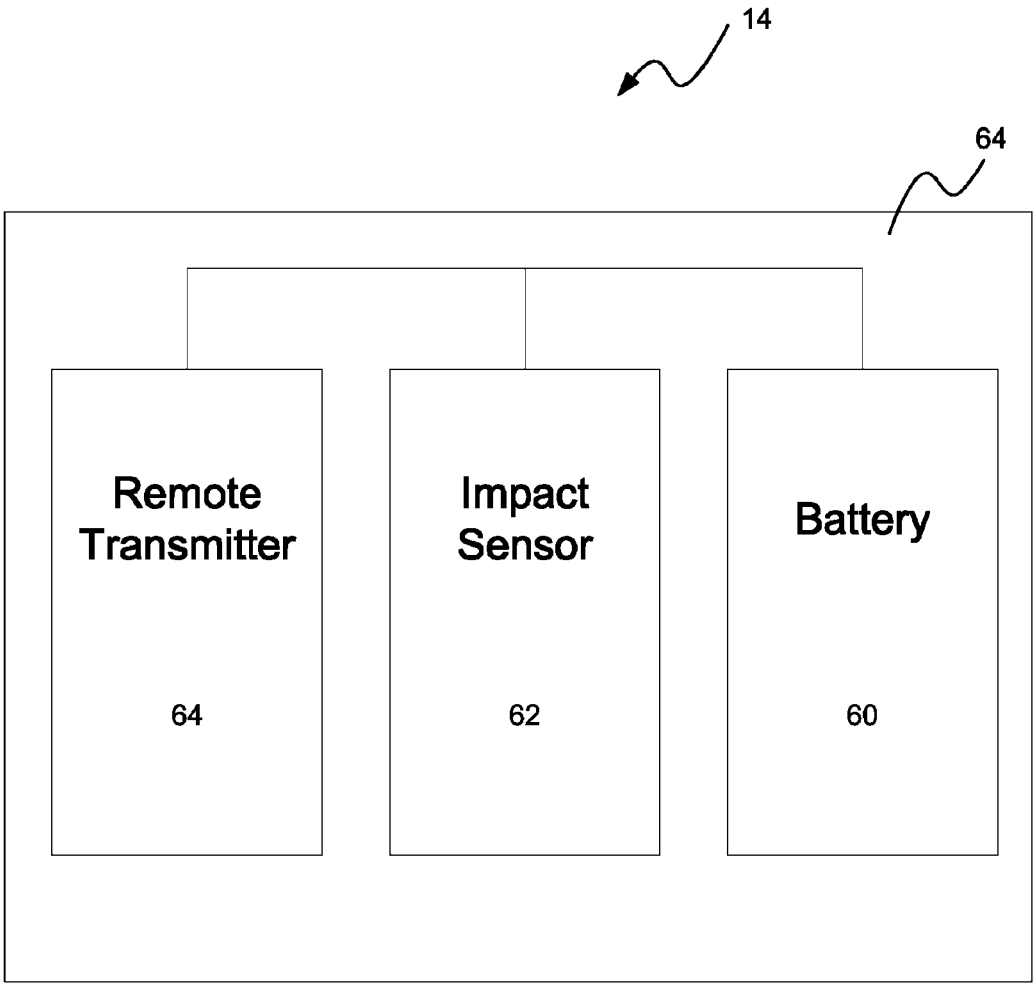
FIG. 3 is a schematic representation of an impact detection module built in accordance with principles of the present invention.

With reference now to FIG. 3, impact detection module 14 is discussed in greater detail. Figure three is a schematic representation of impact detection module 14 and is not meant to be an exhaustive listing its inner working components. In general, impact detection module 14 will include a battery 60, and impact sensor 62, and a remote transmitter 64. Preferably, the battery 60 is rechargeable. Impact detection module 14 is not meant to require a battery, just a suitable power source such as that which might be provided by a solar panel or by other means. In addition to having a battery 60, or some other source of power, impact detection module 14 has an impact sensor 62 which is configured to send a signal to remote transmitter 64 when an impact occurs.

Impact sensor 62 can be designed to send an impact signal to remote transmitter 64 in a variety of ways. Preferably, the impact sensor 62 will be triggered to send a signal to remote transmitter 64 only upon a vibration of a sufficient minimum frequency that is indicative of an impact to the target assembly 10 from a round of ammunition. To this end, impact sensor 62 is preferably equipped with a mechanism to adjust its sensitivity, so that only genuine hits to the target assembly 10 are recorded. Alternatively, impact sensor 62 is configured to send a signal to remote transmitter 64 through the use of movement detection systems, micro reed switches, mercury switches, load switches or other ways of detecting movement on the impact surface of the target. In each case, the impact sensor 62 is preferably equipped with a sensitivity adjustment mechanism to set a minimum threshold value that may be used to avoid false positive signals. Preferably, the battery 60 used in impact detection module 14 is a 6 volt, rechargeable lithium-ion battery pack. Most preferably, the battery 60 is rechargeable via, for example, solar power.

Figure 4:
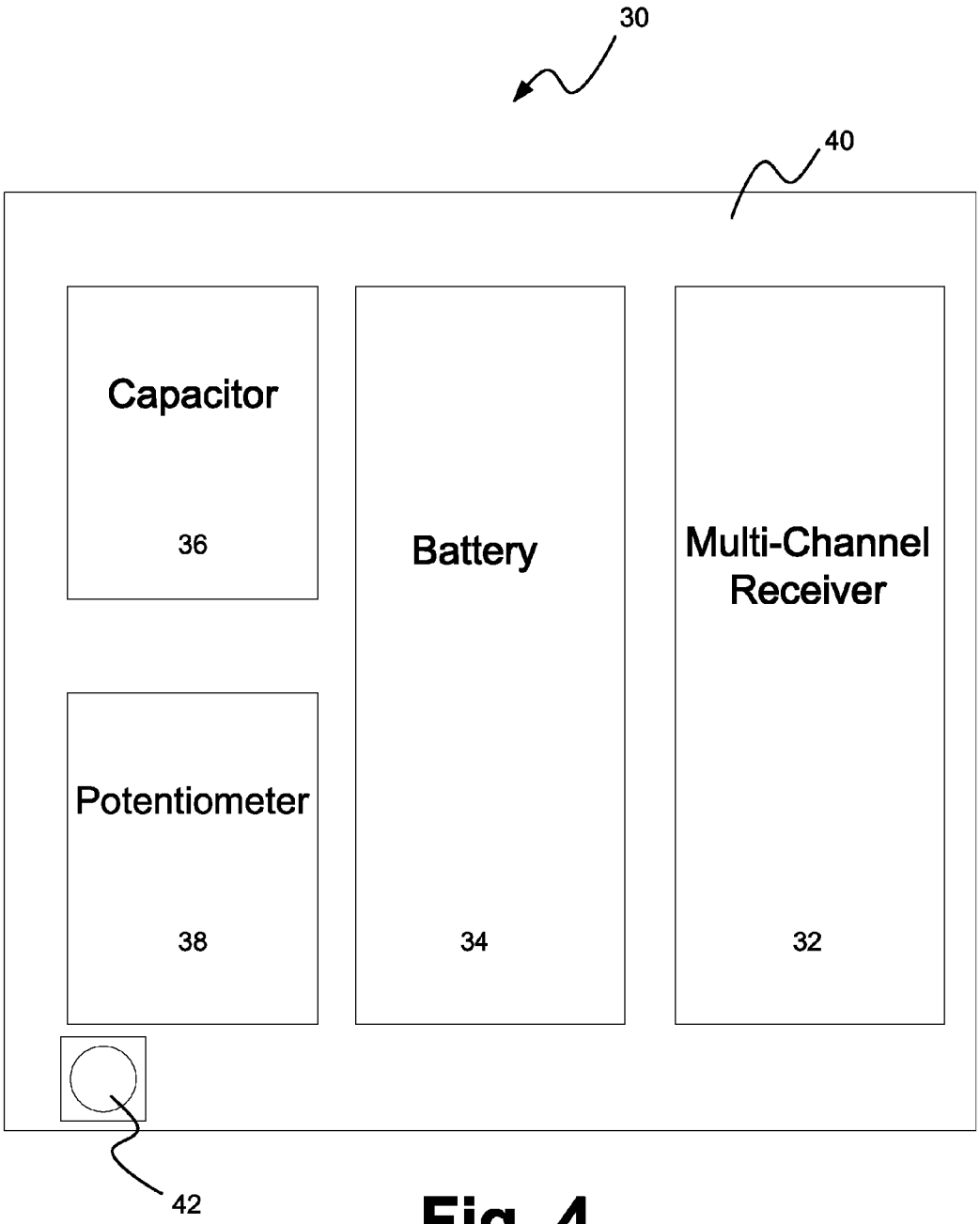
FIG. 4 is a schematic representation of a target control module built in accordance with principles of the present invention.

With reference to FIG. 4, target control module 30 is explained in greater detail. In general, target control module 30 includes a multi-channel receiver 32, a battery 34, a capacitor 36, a potentiometer 38, and an external charge port 42. Target control module 30 includes a water-tight case 40 made from injection-molded plastic or some similar material that may withstand elements and protect internal circuitry from damage. Multi-channel receiver may be configured to receive a variety of different signals. Preferably, multi-channel receiver receives RF signals from multiple sources.

Multichannel receiver 32 has at least two channels; however, in other embodiments, it can be configured to have twelve or more channels. For illustration purposes, multi-channel receiver 32 is configured with two channels, one for receiving signals from the impact detection module 14 and another for receiving signals from a remote control (depicted in FIG. 5). Multichannel receiver 32 is encased in ABS reinforced plastic with a water-tight seal. Multichannel receiver 32 is also equipped with a hole sized to permit free passage or wires to and from the receiver body. Multichannel receiver 32 is preferably equipped with LED indicator lights to indicate that the unit is receiving power and that a signal is being received. Multichannel receiver is preferably one that can be customized through, among other things, the use of dual in-line switches. The switches can be used in coordination with an electrolytic capacitor 36 and a potentiometer 38 in order to create a variable timer for the output signal. As illustrated, the output signal is configured to create a longer signal pulse, which can send longer pulse signals to the light 22, to increase the duration of the flash in order to permit the light 22 to be visible from long range. In general, a pulse that is longer in length is easier to see in unfavorable visibility conditions or over extremely long range, i.e., distances at or slightly over 2000 yards.

As illustrated, multichannel receiver 32, working in conjunction with impact detection module 14 and remote control 70 (shown in FIG. 5) creates two primary modes of operation for target control module 30. The first mode of operation is one in which the light 22 is configured to be illuminated according to a flash pattern over a predefined time interval, preferably between one and three seconds. During the predefined time interval, the light 22 will flash or pulse depending on the desired flash pattern. For example, the light 22 may flash during the predefined time interval at a rate of 3 times per second. Alternatively, the output pulse over the predefined time period might keep the flashing light illuminated for a period of time from 0.3 seconds to as long as 2 seconds.

The length of the predefined time period set for multi-channel receiver 22 and the flash pattern for light 22 during that time period are meant to be completely adjustable and moreover, these may be set according to planned shooter training protocols where the shooter is meant to vary his response and engagement of the target depending on the signal sent from the target. For example, in a series of shooting exercises, the shooter may be trained to recognize a particular flash pattern that is meant to signify "friendly forces" and thereafter, the shooter is trained not to engage those targets which exhibit a particular flash pattern. Additionally, the shooter may be asked to engage targets in a particular order according to a preset series of flash patterns.

The second mode of operation for Target Control module 30 is one in which the light 22 is configured to be illuminated according to a desired flash pattern (or optionally constantly illuminated with no pulse or flashing) until the target assembly is hit. In this mode of operation the light 22 is signaled to be powered on by the shooter or from some other remote location. The target control module, via the multichannel receiver 32 thereby illuminates the light 22 according to the designated flash pattern and the light 22 will be turned completely off in the event the shooter successfully strikes the target. According to this mode of operation, the flash pattern can pulse the light 22 anywhere from 0.3 seconds to over 2 seconds.

In yet another embodiment, the target control module 30 may be configured to alternate modes of operation or flash patterns depending on the number of times the target is hit or depending on the particular part of the target that is hit. As explained in greater detail below, with respect to the multi-quadrant embodiment (discussed with reference to FIGS. 7-10), a predefined flash pattern may indicate that a particular part of the target was hit. Alternatively, the constant flash pattern may be changed in response to a first hit, and then changed again in response to a second hit, and thereafter extinguished in response to a third hit.

Target control module 30 as illustrated is only configured to receive signals, however, the invention is not meant to be limited to such an embodiment. It is within the contemplation of the invention that target control module 30 be configured to send signals, both to the target assembly 10, via impact detection module 14 or via some other communications device attached to the target assembly that is configured to receive signals. Moreover, target control module 30 may be configured to send signals to a remote location such as a remote computer that is programmed via software to control the target assembly, or multiple target assemblies in accordance with a certain shooter training regimen. Additionally, the target control module may be configured to receive signals from a remote location and then communicate those signals to the target assembly 10 via impact detection module 14. For example, the target control module 30 may be configured to communicate to the impact detection module 14 in response to a remote signal, wherein the remote signal is one indicating movement for the target assembly 10 or indicating the creation of a particular heating apparatus to allow the target to be seen through night vision optical devices.

Multichannel receiver 32, in addition to being in wired communication with antenna 26 (shown in FIG. 2), preferably includes, for at least one channel, an enhanced internal antenna for wireless communication at ranges up to 200 yards. In addition, multichannel receiver preferably includes a programmable microprocessor that can be programmed to pulse the light 22 according to a series of several different flash patterns. Additionally, the microprocessor of multi-channel receiver 32 may be programmed to make the target control module automatically power on or power off in response to various signals or energy states, or to preserve battery life. The battery 34 of target control module 30 is preferably rechargeable and capable of delivering up to 12 volts of direct current at no more than 5 Amps. The battery 34 is rechargeable via external charge port 42.

Figure 5:
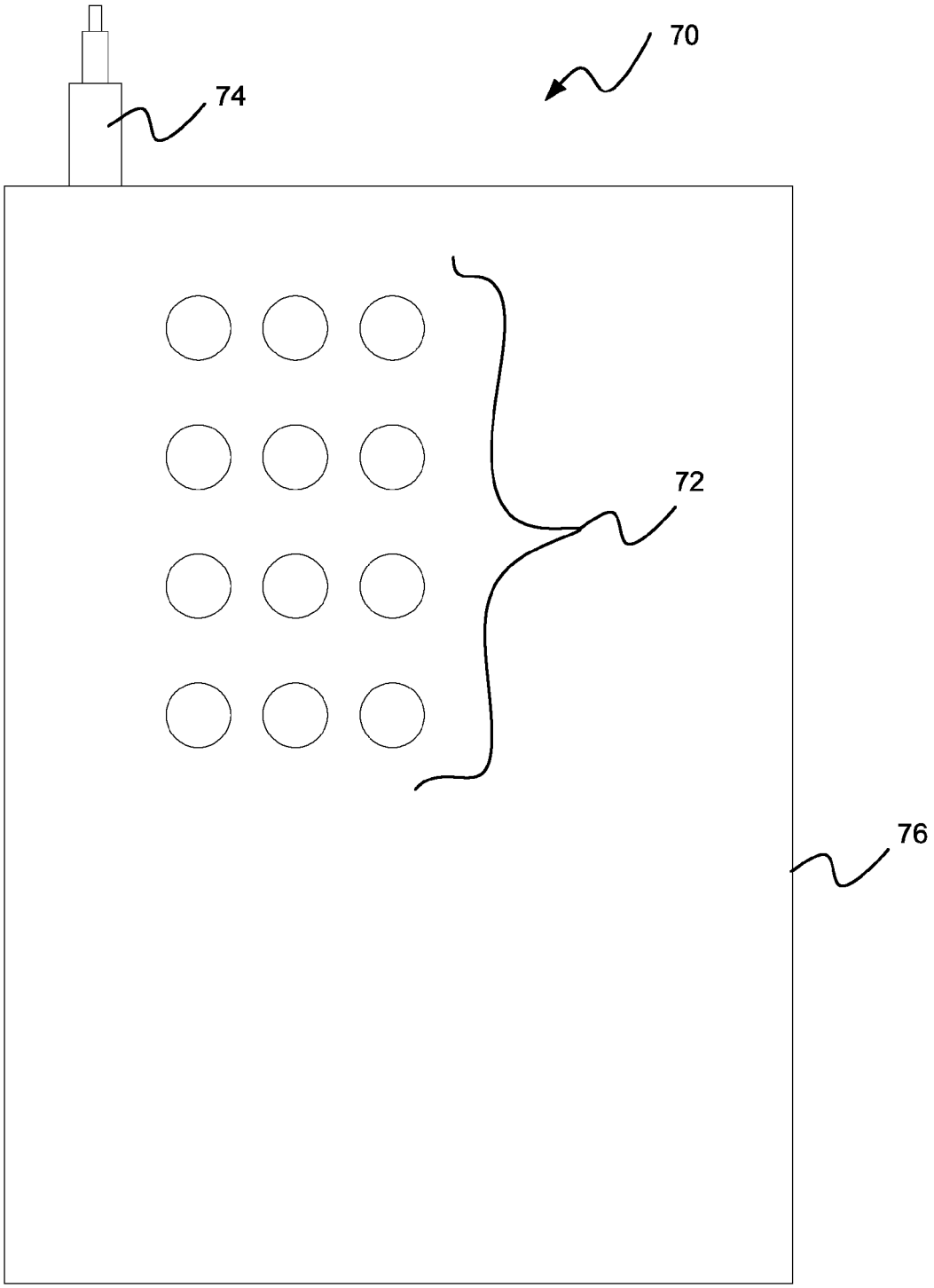
FIG. 5 is a remote control module programmable and useable in accordance with principles of the present invention.

Turning now to FIG. 5, a remote control 70 useable consistent with the principals of the present invention is hereby described in greater detail. Remote control 70 has a series of twelve buttons 72, a water-resistant injection-molded plastic case 76, and an external antenna 74. Remote control 70 is preferably one that is capable of communication over long ranges, preferably more than 500 yards, and more preferably as long as about 2000 yards. Remote control 70 is preferably configurable to communicate with the target control module 30 using RF signals. The RF signals from remote control 70 are configurable over a variable range of frequency. Preferably, the frequencies over which the remote control 70 may communicate are 250 MHz to 450 MHz. Each of the 12 buttons 72 may be configured to communicate on a particular frequency and thereby distinguish between multiple receivers in the field. For example, the remote control 70 may be configured such that the first button is configured to communicate with a first target assembly and a first target control module, such that the first button on remote control 70 is capable of testing the target assembly 10, specifically, the impact detection module 14 and the target control module 30. For example, in response to pressing the first button of remote control 70, the first target assembly 10 and the first target indication assembly 20 will be illuminated to indicate that the target is ready to be engaged.

The remote control 70 preferably is powered via a 9-volt battery and it preferably includes a telescoping antenna. Additionally, remote control 70 operates at a range of 15-40 mA and output power of about 3-15 mW.

Figure 6:
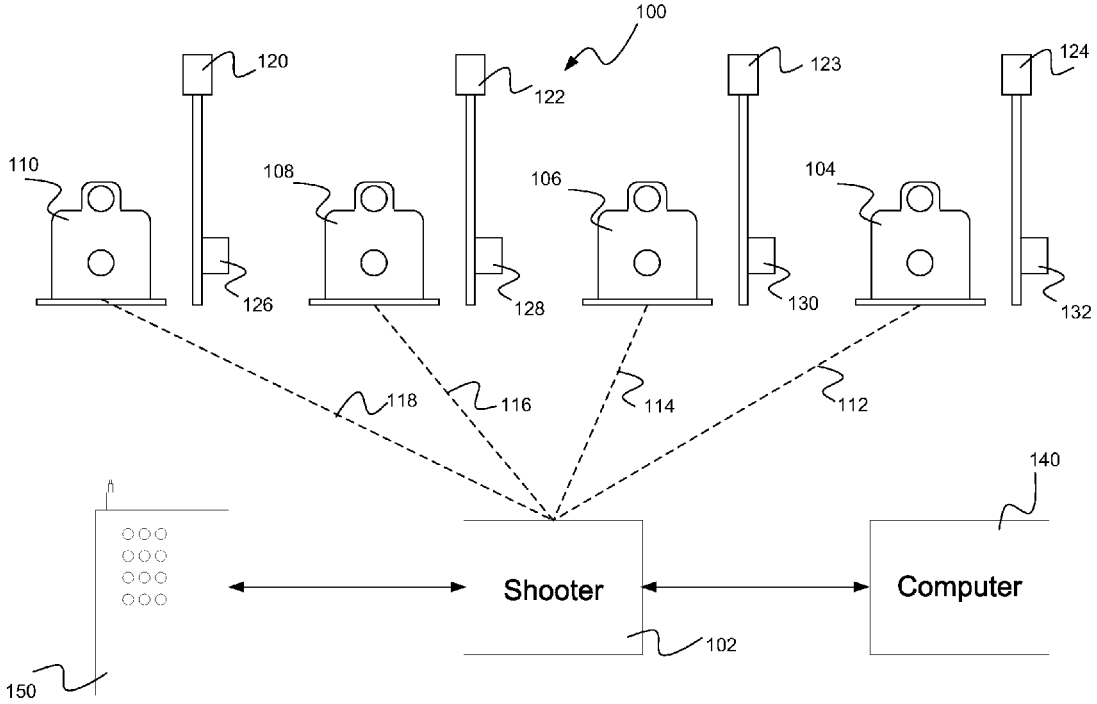
FIG. 6 is a schematic representation of an interactive long range target shooting system constructed in accordance with principles of the present invention.

With reference now to FIG. 6, a schematic representation of an interactive long range target shooting system constructed in accordance with principles of the present invention is shown. Interactive long range target shooting system 100 is illustrated using four targets. One of ordinary skill in the art will understand that the number of targets designated in the field is up to the shooter or to the training regimen. The number of targets depicted is therefore not intended to be limiting in any way. As depicted, there is a shooter 102, a first target assembly 104, a second target assembly 106, a third target assembly 108, and a fourth target assembly 110. The shooter 102 preferably has direct lines of sight, 112, 114, 116, and 118 to the target assemblies, 102, 104, 106 and 108. In the schematic representation, it appears that each target assembly is at about the same distance away from the shooter 102, but this is purely for illustration. In reality, each target assembly can be at a different distance away from the shooter 102 or they can be at the same distance. Moreover, each target assembly, 104, 106, 108, and 110, may also be mounted to tracks or other means for movement, such that they are able to be moved at varying distances away from the shooter to increase the difficulty in the training exercise.

As depicted in FIG. 6, a computer 140 may be used and may be programmed to be in communication with each target assembly, 104, 106, 108, and 110. The computer 140 may be in communication via the target control modules, 126, 128, 130, and 132. The computer program can be set to a predefined training regimen, designed to have the shooter engage different targets. The computer may also alter the flash patterns of the lights 120, 122, 123, and 124, to correspond with different training conditions that the shooter 102 must respond to in real time. Moreover, the remote control 150 may also be used from a remote location, in communication with the computer to carry out any number of pre-programmed target training exercises.

Figure 7:
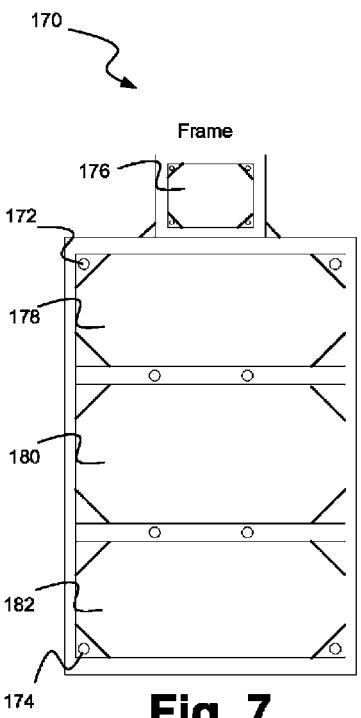
FIG. 7 is a frame for a multi-quadrant target constructed in accordance with principles of the present invention.
Figure 8:
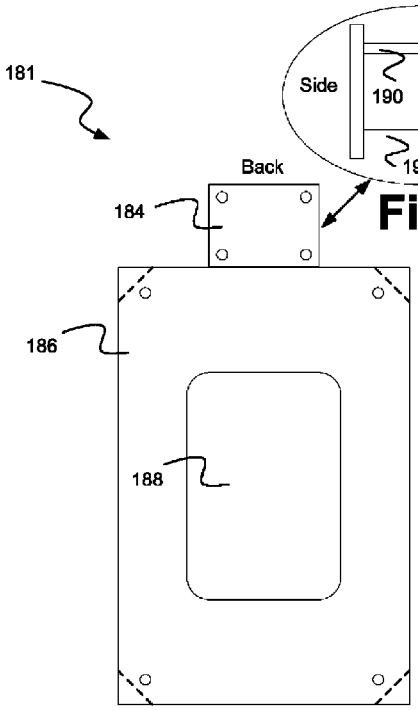
FIG. 8 is a panel assembly for a multi-quadrant target constructed in accordance with principles of the present invention.

With reference now to FIGS. 7-8, an additional embodiment for the target assembly is disclosed. FIG. 7 discloses a frame 170 for a multi-quadrant target assembly. The Frame 160 is constructed from highly durable materials, such as R5400 steel or HARDOX500 steel. The frame 170 includes switch holes 172 that are placed optionally at the corner of each frame area. The frame 170 includes a head frame area 176, an upper frame area 180, and a lower frame area 182. The size and dimensions of frame 170 are variable, of course, depending on the desired shape of the target assembly.

FIG. 8 discloses the panel assembly constructed in accordance with principles of the invention. FIG. 8 includes an outer body panel 186, an inner body panel 188, and a head panel 184. Each of the panels of the multi-quadrant assembly is intended to record a hit to that individual panel through switches that will be triggered upon the depression of the panel in the direction of impact. The impact surface of each panel is steel plated, preferably made from AR Hardox R600, R500, or similarly durable material.

Figure 9:
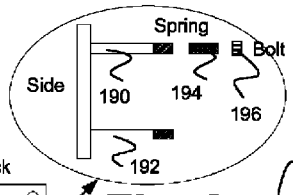
FIG. 9 is a side view of a panel for a multi-quadrant target constructed in accordance with principles of the present invention.

FIG. 9 shows a side view of a panel for the multi-quadrant target assembly constructed in accordance with the present invention. FIG. 9 shows upper bolt dowels 190 and lower bolt dowels 192. The upper and lower bolt dowels (four total) are threaded and configured to each receive a nut 196. The nut 196 is used to secure the panel to the frame 170, whereby the dowels 190 are inserted into switch dowel holes 172. A nut 196 is used to secure the several dowels 190 to the frame 170 and a spring 194 is used to absorb shock and vibration that can be experienced when the panel is struck by a round of ammunition.

Figure 10:
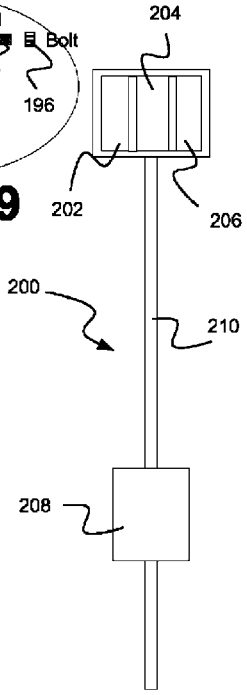
FIG. 10 is a target indication assembly, representative of the kind built in accordance with principles of the present invention.

FIG. 10 shows a hit indication assembly 200 for an interactive multi-quadrant target. The hit indication assembly 200 includes a first light 202, a second light 204, and third light 206. Each light, 202, 204, and 206 can be LED lights of the same general construction and power demand as the light 22 (shown in FIG. 2) with the exception being that these lights, 202, 204, and 206, are preferably of different colors. In this embodiment, the first light 202 is preferably an amber light, which indicates a strike to the inner body panel 188. The second light 204 can be a blue light that indicates a strike to the outer body panel 186. Finally the third light 206 is preferably a red light indicating a strike to the head panel 184.

FIG. 10 also shows other parts of the target indication assembly 200 including the pole 210 and the target control module 208. The target control module 208 can be configured to receive signals in the same way as discussed above with respect to target control module 30 (depicted in FIG. 4). Additionally, the multi-quadrant target assembly can also be equipped with an impact detection module that is in wired or wireless communication with the panels 188, 186, and 184, and the target control module 208. The impact detection module useable with the multi-quadrant target assembly can be constructed the same way as discussed with respect to the impact detection module 14 (depicted in FIG. 3).

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An interactive target for long range shooting comprising:

a target assembly wherein the target assembly includes an impact surface;

an impact detection module, wherein the impact detection module includes an impact sensor, a remote transmitter, and a battery;

a light;

a target control module, wherein the target control module includes a multi-channel receiver, a battery, a capacitor, and a potentiometer;

wherein the impact detection module is configured to detect a strike from a round of ammunition coming into contact with the impact surface;

wherein the light is wired to the target control module and where the target control module is configured to receive a wireless signal from the impact detection module; and wherein the light is illuminated in response to the strike to the impact surface of the round of ammunition.

2. The interactive target of claim 1 wherein the target includes a hinge.

3. The interactive target of claim 1 wherein the light when illuminated is visible from distances of at least 500 yards.

4. The interactive target of claim 1 wherein the light is configured to flash according to a variety of flash patterns.

5. The interactive target of claim 1 wherein the impact surface comprises a plurality of plates.

6. The interactive target of claim 5 wherein said plurality of plates is connected to a plurality of switches, wherein said plurality of switches is configured to detect a strike to said plurality of plates.

7. The interactive target of claim 6 wherein the plurality of switches is configured to send signals to said target control module, and thereby illuminate the light.

8. An interactive target for long range shooting, the interactive target comprising: a target assembly with an impact surface, the target assembly further including a target control module and a light; wherein the target control module is wired to the light; wherein the target control module has a multi-channel receiver configured to receive signals from a plurality of remote devices; and wherein the plurality of remote devices includes a remote control.

9. The interactive target of claim 8 wherein the plurality of remote devices includes a computer.

10. The interactive target of claim 8 wherein the plurality of remote devices includes an impact detection module.

11. A system for long range shooting comprising:

a plurality of targets;

a plurality of impact detection modules;

a plurality of target control modules;

a plurality of lights;

a computer programmed to identify at least one of said plurality of targets according to a predefined flash pattern;

wherein the plurality of targets are moveable in response to signals received by the plurality of target control modules.

12. The system for long range shooting of claim 11 wherein the computer is programmed to send signals to the plurality of target control modules.

13. The system for long range shooting of claim 11 wherein the plurality of lights are visible at distances greater than 500 yards.

14. The system for long range shooting of claim 11 wherein the computer is configured to send wireless signals to the plurality of target control modules and the plurality of impact detection modules.

* * * * *